US005674096A

United States Patent [19]

Duclos et al.

[11] Patent Number: 5,674,096

[45] Date of Patent: Oct. 7, 1997

[54] ELECTRICAL CONNECTOR HOUSING MEMBER

[75] Inventors: Jean-Louis Duclos, Elancourt; Marie-Pierre Mortureux, Le Pecq, both of France

[73] Assignee: Connecteurs Cinch, Montigny Le Bretonneux, France

[21] Appl. No.: 576,017

[22] Filed: Dec. 21, 1995

[30] Foreign Application Priority Data

Jan. 18, 1995 [FR] France ..... 95 00531

[51] Int. Cl.[6] ..... H01R 13/514

[52] U.S. Cl. ..... 439/752

[58] Field of Search ..... 439/752

[56] References Cited

U.S. PATENT DOCUMENTS 4,867,712 9/1989 Kato et al. .

5,257,951 11/1993 Maeda ..... 439/752

FOREIGN PATENT DOCUMENTS 2408231 11/1977 France .

3828872 3/1989 Germany .

4318509 12/1993 Germany .

2211033 6/1989 United Kingdom .

*Primary Examiner*—Neil Abrams

*Assistant Examiner*—Eugene Byrd

[57] ABSTRACT

An electrical connector housing member includes a body with passages to receive a contact member and a locking key with protuberances which engage in slots opening into the passages. The width of the protuberances is equal to the dimension of the slots which extend the full width of the passages and the protuberances are extended by bosses.

2 Claims, 2 Drawing Sheets

ELECTRICAL CONNECTOR HOUSING MEMBER

BACKGROUND OF THE INVENTION

1. Field of the Invention

The present invention concerns an electrical connector housing member.

The invention concerns electrical housing members comprising a body with a row of passages accommodating electrical contact members including a shoulder from which extends a flat strip terminating in lugs to be crimped to a conductor and reinforced by a stamped portion.

2. Description of the Prior Art

In such connectors there are provided means for retaining the electrical contact members in the passages and a locking key that can occupy a pre-locked position allowing insertion of the electrical contact members into the passages and a locked position in which it immobilizes the members in the passages.

The locking key usually has protuberances which are inserted into slots in the housing member which open into the passages.

The invention is directed to housing members of this kind that are usually very small and where the electrical contact members are also very small.

The locking keys not only immobilize the contact members in the passages but also provide confirmation that the members are correctly located.

Given the small sizes involved, it has been found that the keys do not effectively lock the electrical contact members and that the confirmation of correct location of the latter in the passages is insufficient.

One object of the present invention is to overcome these drawbacks.

SUMMARY OF THE INVENTION

The electrical connector housing member of the invention comprises an insulative material body having a row of parallel passages each adapted to receive an electrical contact member having a body with an elastic clamp at one end and the other end extended by a flat strip terminating at crimping lugs and incorporating a stamped portion, each passage including a retaining abutment for the electrical contact member and retaining means conjugate with corresponding means on the body of the electrical contact member, a locking key being mounted on the body of the housing member and including protuberances adapted to be engaged in slots opening into the passages, the key being adapted to occupy a pre-locked position in which the electrical contact members can be inserted freely into the passages and a locked position in which the protuberances are inserted in the slots and cooperate with the flat strips and with the shoulders of the electrical contact members, in which housing member the length of the slots corresponds to the width of the passages and the width of the protuberances corresponds to the length of the slots less the thickness of the flat strip, the free end of the protuberances being extended by a boss adapted to extend as far as the stamped portion of the electrical contact members.

Accordingly, the bosses detect perfectly incomplete engagement of the electrical contact members and thus oppose locking of the key.

Moreover, with the bosses the protuberances form a large abutment opposing pulling out of the electrical contact members.

A specific embodiment of the invention will now be described in more detail, by way of example and with reference to the appended drawings.

DETAILED DESCRIPTION OF THE PREFERRED EMBODIMENT

The various figures show an electrical connector housing member comprising an insulative material body 1 in which there are three passages 2 each adapted to receive a female electrical contact member 3.

Figure 6:
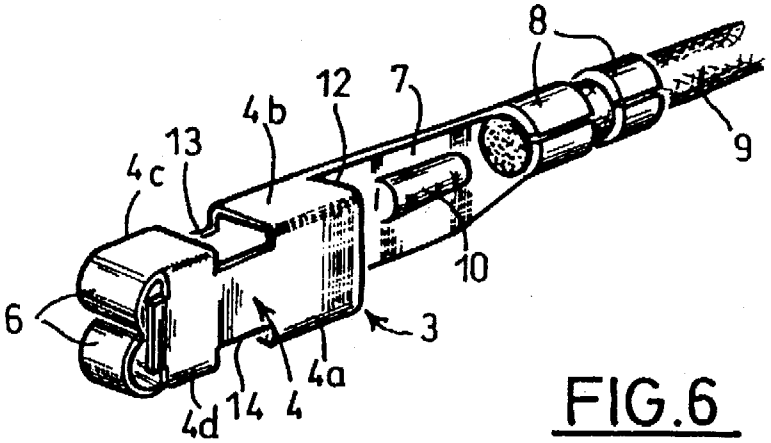
FIG. 6 is a perspective view of a female electrical contact member adapted to be fitted to the housing member of the invention.

The female electrical contact member 3 is shown in perspective in FIG. 6 and comprises a generally parallelepiped-shaped body 4 with four sides 4*a*, 4*b*, 4*c* and 4*d*, the walls 4*b* and 4*d* being extended at one end to form an inwardly bent elastic clamp 6. At the end opposite the clamp 6, the side 4*c* is extended by a flat strip 7 having lugs 8 for crimping to a conductor 9.

To stiffen the flat strip 7 a stamped portion 10 projects from its side facing towards the wall 4*a*.

On the same side as the strip 7, the body 4 forms a shoulder 12 and has respective openings 13 and 14 in the walls 4*b* and 4*d*.

The passages 2 have at one end an opening 15 for inserting the members 3 and at the other end an abutment 16 for retaining the members with a slot 17 for inserting male electrical contact members adapted to be inserted into the clamps 6.

In each passage 2 is an elastic retaining lug 19 having a peg 20 adapted to be inserted into an opening 13 or 14 according to which of two positions, angularly offset by 180°, the member 3 is inserted in.

At the same end as the opening 15, the member 20 has an inclined ramp. At the opposite end it is terminated at a step so that the member 3 can be easily inserted and, when correctly engaged, locked in position.

The body 1 has on each of its two sides 22 and 23 guides 24 and 26, respectively, for a locking key 25 and a projecting strip 30 parallel to and between the guides. On the side 22, between the strip 30 and the guide 24, there is a retaining strip 27 with a ramp 27*a* and a step 27*b*, a corresponding retaining strip 31 being provided between the strip 30 on the side 23 and the guide 26.

The key 25 has a generally rectangular bottom 28 near each corner of which is a pillar 29, the pillars 29 being linked in pairs by crossmembers 33 shaped to mate with the strips 30.

On their sides facing towards each other, the crossmembers 33 have pegs 40 with ramps 40*a* at the end facing the free ends of the pillars and steps 40*b* at the other end.

When the pegs 40 cooperate with the strips 27 and 31, the key is in a pre-locked position. Two further retaining strips 41 and 42 are provided, the strip 41 extending between the strip 30 and the guide 24 and the strip 42 extending between the strip 30 and the guide 26, these strips being offset in the heightwise direction relative to the strips 27 and 31 so that the key 25 is held in the locked position when the pegs 40 cooperate with them.

To the rear of the elastic retaining lugs 19 the body 1 incorporates slots 45 which open into the parts of the passages 2 containing the flat strips 7. In the corresponding part of the key 25 there are protuberances 47 ending at a boss 48 extending the protuberance. The length of the slots 45 corresponds to the width of the passages 2 and the width of the protuberances 47 corresponds to the length of the slots 45 less the thickness of the flat strip 7 on each side.

Figure 1:
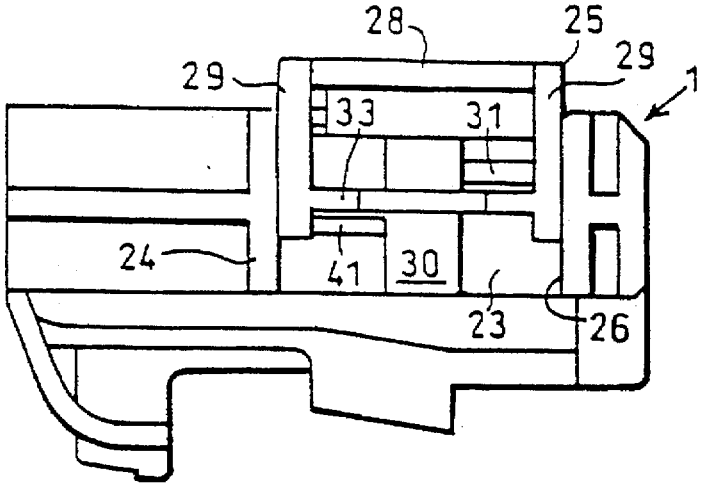
FIG. 1 is a side elevation view of an electrical connector housing member of the invention.
Figure 2:
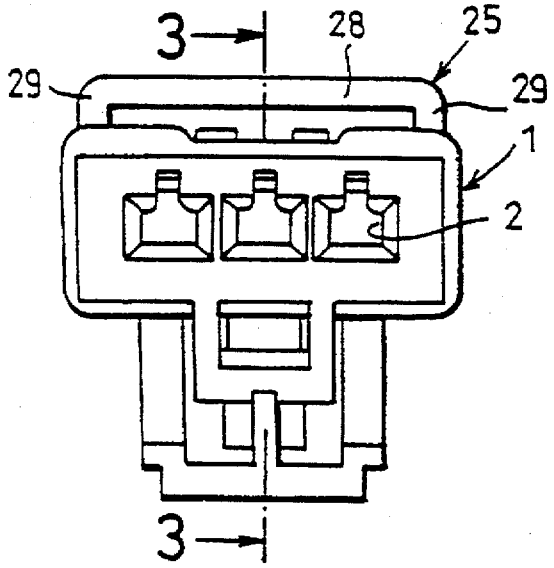
FIG. 2 is a front elevation view of the housing member from FIG. 1.
Figure 3:
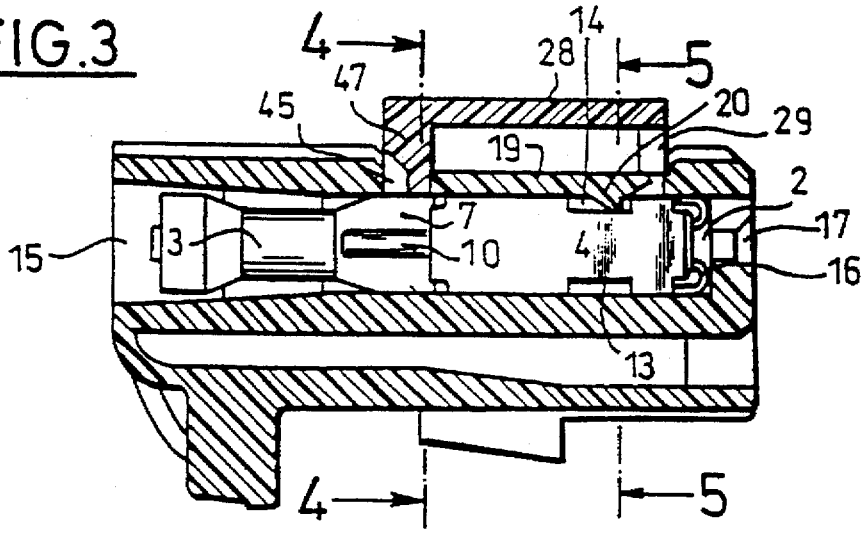
FIG. 3 is a view in section on the line 3—3 in FIG. 2.
Figure 5:
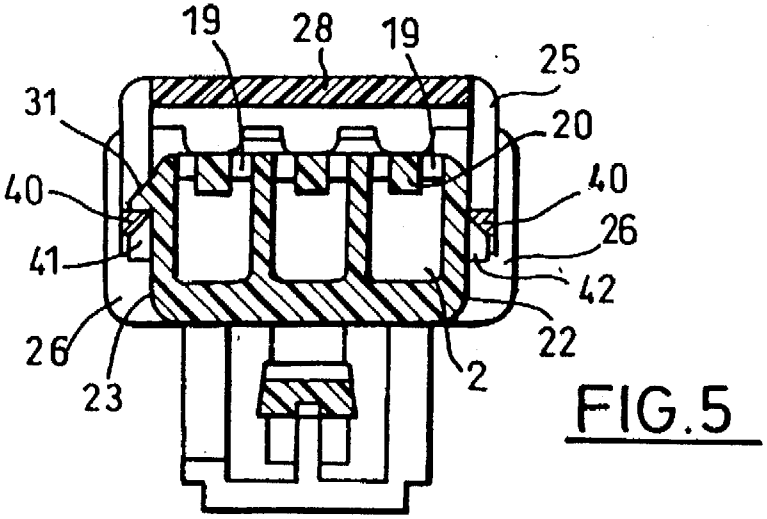
FIG. 5 is a view in section on the line 5—5 in FIG. 3.
Figure 4:
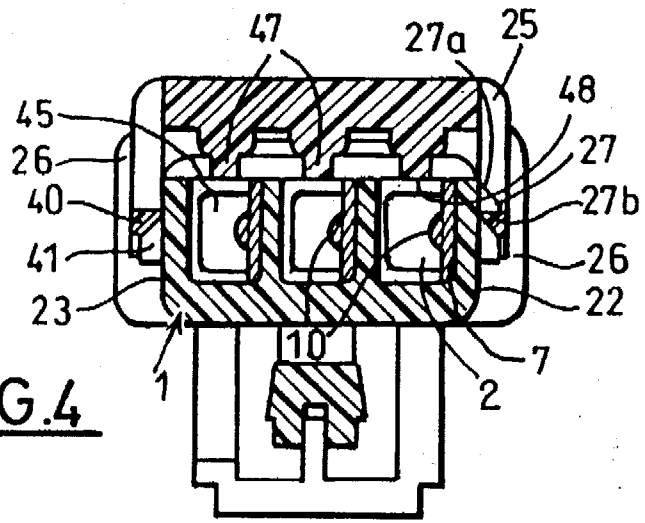
FIG. 4 is a view in section on the line 4—4 in FIG. 3.
Figure 7:
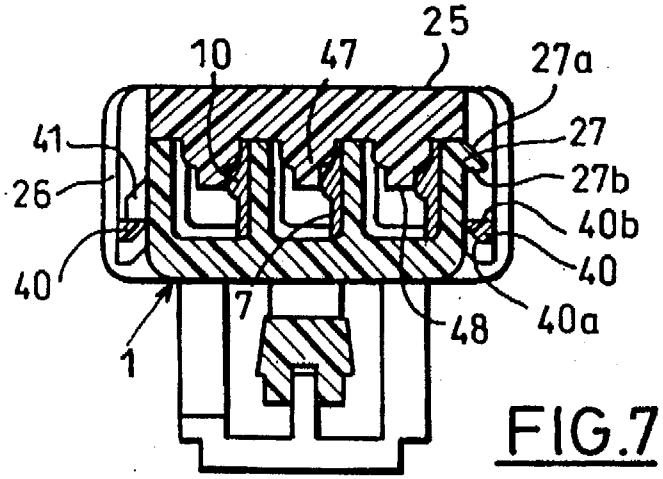
FIG. 7 is a sectional view corresponding to FIG. 4 showing the locking key in the locked position.

As can be seen in FIGS. 2 and 4, when the key is in the pre-locked position the protuberances and the bosses 48 are out of the slots 45 enabling easy insertion of the contact members 3.

If a contact member 3 is not correctly inserted into the corresponding passage 2, the key 25 cannot be locked since the boss 48 abuts on the wall 4*a* or 4*d*, depending on the position in which the member was inserted.

When the key 25 is in the locked position the protuberances 47 and the bosses 48 form a large abutment which, braced against the shoulder 12, opposes unintentional pulling out of the members 3. Note that the bosses 48 extend as far as the stamped portions 10.

Of course, the invention is not limited to the embodiment just described and shown. Many modifications of detail may be made thereto without departing from the scope of the invention.

There is claimed:

1. Electrical connector housing member, comprising:

an insulative material housing body comprising a row of parallel passages, each of the passages being adapted to receive an electrical contact member, the electrical contact member comprising a member including a contact body having two ends, an elastic clamp positioned on one of the two ends, the other of the two ends being extended by a flat strip terminated by crimping lugs, the contact body including a stamped portion, and a shoulder positioned between the contact body and the flat strip;

each of the passages including a retaining abutment for the electrical contact member, an elastic lug including a peg adapted to be inserted into an opening of the body, and a slot opening into the passage;

a locking key mounted on the housing body, the locking key comprising a bottom including protuberances, each of the protuberances adapted to be engaged in one of the passages and comprising a free end and a boss positioned on the free end and extending the protuberance, the locking key comprising a prelocked position in which the free ends and the bosses are positioned outside of the passages so that the electrical contact members can be freely inserted into the passages, and a locked position in which the protuberances are inserted into the slots and passages to cooperate with the flat strips and shoulders so that the boss extends as far as the stamped portion; and the slots comprise a length that substantially correspond to the width of the protuberances; and the width of the protuberances corresponds to the length of the slots less a thickness of the flat strip.

2. In combination, the electrical connector housing member as recited in claim 1 and a plurality of electrical contact members, each of the electrical contact members comprising a member including a contact body having two ends, an elastic clamp on one of the two ends, the other of the two ends being extended by a flat strip terminated by crimping lugs, the contact body including a stamped portion, and a shoulder positioned between the contact body and the flat strip.

* * * * *